US007124606B2

(12) United States Patent
Turek

(10) Patent No.: US 7,124,606 B2
(45) Date of Patent: Oct. 24, 2006

(54) LOCKOUT SAFETY HASP

(75) Inventor: Mark E. Turek, Wheaton, IL (US)

(73) Assignee: Brady Worldwide, Inc., Milwaukee, WI (US)

( * ) Notice: Subject to any disclaimer, the term of this patent is extended or adjusted under 35 U.S.C. 154(b) by 0 days.

(21) Appl. No.: 10/912,623

(22) Filed: Aug. 5, 2004

(65) Prior Publication Data

US 2005/0028569 A1 Feb. 10, 2005

Related U.S. Application Data

(60) Provisional application No. 60/493,154, filed on Aug. 7, 2003.

(51) Int. Cl.
*E05B 73/00* (2006.01)

(52) U.S. Cl. ..... 70/14; 70/52; 70/53; 70/56

(58) Field of Classification Search ..... 292/307 R; 70/14, 18, 19, 52–56, DIG. 63, 20, 21
See application file for complete search history.

(56) References Cited

U.S. PATENT DOCUMENTS

| | | | | |
|---|---|---|---|---|
| 1,197,020 | A | 9/1916 | Farrar | |
| 2,469,592 | A | 5/1949 | Byer | |
| 2,963,695 | A | 12/1960 | Thomas | |
| 3,513,675 | A | 5/1970 | Ryder, Jr. et al. | |
| 3,667,259 | A | 6/1972 | Reque et al. | |
| 3,703,821 | A | 11/1972 | Dorey | |
| 3,736,781 | A | 6/1973 | Foote | |
| 4,070,879 | A | 1/1978 | Thompson | |
| 4,085,599 | A | 4/1978 | Fischer et al. | |
| 4,864,834 | A | 9/1989 | Waite | |
| 5,020,342 | A | 6/1991 | Doan et al. | |
| 5,167,135 | A | 12/1992 | Gobeski | |
| 5,365,757 | A | 11/1994 | Primeau | |
| 5,582,042 | A * | 12/1996 | Mordick | 70/14 |
| 5,743,116 | A * | 4/1998 | Suster | 70/14 |
| 5,881,582 | A | 3/1999 | Monaco | |
| D455,637 | S * | 4/2002 | Reed | D8/333 |
| 6,530,248 | B1 | 3/2003 | Parker | |
| 6,557,384 | B1 | 5/2003 | Cuesta | |
| 6,578,886 | B1 * | 6/2003 | Bystry et al. | 292/307 R |
| 2004/0211232 | A1 * | 10/2004 | Ling et al. | 70/51 |
| 2004/0226324 | A1 * | 11/2004 | Loughlin et al. | 70/25 |
| 2004/0255624 | A1 * | 12/2004 | Loughlin et al. | 70/56 |

* cited by examiner

*Primary Examiner*—Suzanne Dino Barrett
(74) *Attorney, Agent, or Firm*—Quarles & Brady LLP

(57) ABSTRACT

A lockout safety hasp is provided including a rotational shackle coupled to a top of a body having a U-shaped securing beam extending from the bottom thereof. A slidable cover is received on the body and is moveable between a closed position in which the rotatable shackle is locked in place and an open position in which the shackle is free to rotate. The securing beam is generally U-shaped and provides an opening sized and dimensioned to receive one or more padlocks, the padlocks preventing the cover from moving out of the closed position until all of the padlocks are removed. The components of the lockout safety hasp can be constructed of a plastic or a plastic polymer, and snap fit together to provide an inexpensive and easy to manufacture device.

27 Claims, 3 Drawing Sheets

LOCKOUT SAFETY HASP

CROSS-REFERENCE TO RELATED APPLICATION

This application claims the benefit of provisional patent application No. 60/493,154, filed Aug. 7, 2003, entitled "Lockout Safety Hasp" incorporated herein by reference.

BACKGROUND OF THE INVENTION

The present invention generally relates to a locking device for securing machinery while workers perform maintenance on the machinery. More particularly, the present invention relates to a plastic lockout safety hasp that a technician may connect to a corresponding safety hasp on the machinery to prevent access to operational controls of the machinery while the technician works on the machinery.

In the case of large machines, for example, energy sources, assembly and maintenance of the machines requires the work of several different kinds of technicians at any one time. A large energy machine may have electricians, pipe fitters, welders, and outside contractors all working on the machine at the same time. The machine typically has a safety device that prevents access to operational controls on the machine. The safety device has a lockout hasp that may be secured by the technicians such that individuals do not have access to the operational controls on the machine.

There are a number of conventional lockout hasps that are used to secure machinery. Typically, a lockout hasp is made of metal, such as steel or aluminum, and has a body that receives a shackle therein. In operation, the shackle is extended through a lockout feature on the safety device of the machine and then secured within the body to prevent access to the machine's operational controls. The body has a number of apertures that may receive a technician's personal padlock such that the shackle is locked in the body and thus cannot be removed from the lockout feature on the machine.

Each individual technician that is working on the machine has a padlock that he or she secures about the lockout hasp such that the lockout hasp is locked about the safety device to prevent access to the operational controls. Because the lockout hasp is structured to accommodate multiple padlocks, several technicians may secure their padlocks to the lockout hasp at any one time. Thus, by securing the lockout hasp with his or her own padlock, each individual technician is able to safely work on the machine without another individual coming along and operating the machine. Additionally, a shop may use lockout hasps having different colors in order to indicate which technicians are working on a particular part of the machine. For example, a shop may assign red hasps to electricians, blue hasps to pipe-fitters, yellow hasps to gas line workers, etc. When each technician is done working on the machine, the technician unlocks his or her padlock from the lockout hasp. Thus, all the technicians on the job have to remove their padlocks from the lockout hasp before the machine may be operated.

The typical lockout hasp suffers from several drawbacks. Because most lockout hasps are made of metal, the lockout hasps must go through a number of different expensive processes during production. For example, the lockout hasp may have to be cast, welded, machined, and undergo metal finishing processes. Additionally, coloring a metal hasp during production is costly and involves another production step. Therefore, manufacturing metal lockout hasps is expensive and time-consuming. Additionally, while some lockout hasps have been made of nylon, the nylon hasps have a thin diameter and may easily be cut off of the machine with wire cutters or even scissors. Because the typical nylon lockout hasp may be so easily disengaged from the machine, it does not provide an adequately safe work environment for a technician working on a machine.

Thus a need exists for a lockout hasp that is inexpensive and simple to manufacture and yet is also strong enough to provide adequate protection to a technician who secures the hasp to a machine.

SUMMARY OF THE INVENTION

In one aspect of the invention, a lockout hasp is provided including a substantially U-shaped shackle, a body, and a cover. The shackle includes a connecting projection at a distal end, and the body includes a first and a second channel, each of the channels sized and dimensioned to receive a leg of the shackle. A chamber is formed at the bottom of one of the channels, sized and dimensioned to receive the connecting projection formed in the shackle. The cover includes first and second retention beams that are sized and dimensioned to be received in slidable engagement in the first and second channels in the body, respectively, wherein the shackle is positionable in the two channels and the connecting projection is snap-fit into the chamber in the body, and the cover is slidably received on the body. The body further includes a U-shaped securing beam extending below the bottom edge of the body, and the cover is moveable between a first position in which the cover encloses the channel to prevent rotation of the shackle and a second position in which the cover is removed from the channel to allow rotation of the shackle. Each of the components can be injected molded of a plastic, or a plastic polymer material, and the components can then be snap fit together to provide the hasp.

In another aspect, the present invention provides a lockout hasp comprising a body having a shackle coupled to a first end and a securing beam coupled to a second end. The securing beam including first and second ends which are coupled to the body provide a padlock opening for receiving a shackle from a plurality of padlocks. A cover slidably received on the body, and is slidable between a first position in which the shackle is closed and a second position in which the shackle is open. The cover is prevented from moving to the open position by interference between at least one padlock received on the U-shaped securing beam and the cover, thereby providing a lockout function.

In yet another aspect of the invention, a lockout hasp is provided including a body having a first and second channels in a first end and a U-shaped securing beam extending from a second end. A shackle is received in the first and second channels, and includes a first end which is rotatably secured in one of the first and second channels and a second end which is moveable around the rotatably secured end and relative to the body. A cover is slidably engaged in the body and is moveable between an open position in which the shackle is free to rotate and a closed position in which the shackle is locked. The U-shaped securing beam provides a padlock opening sized and dimensioned to receive at least one padlock, and the cover is prevented from moving to the open position when a padlock is received on the U-shaped securing beam.

These and other aspects of the invention will become apparent from the following description. In the description, reference is made to the accompanying drawings which form a part hereof, and in which there is shown a preferred embodiment of the invention. Such embodiment does not necessarily represent the full scope of the invention and reference is made therefore, to the claims herein for interpreting the scope of the invention.

DETAILED DESCRIPTION OF A PREFERRED EMBODIMENT

Figure 1:
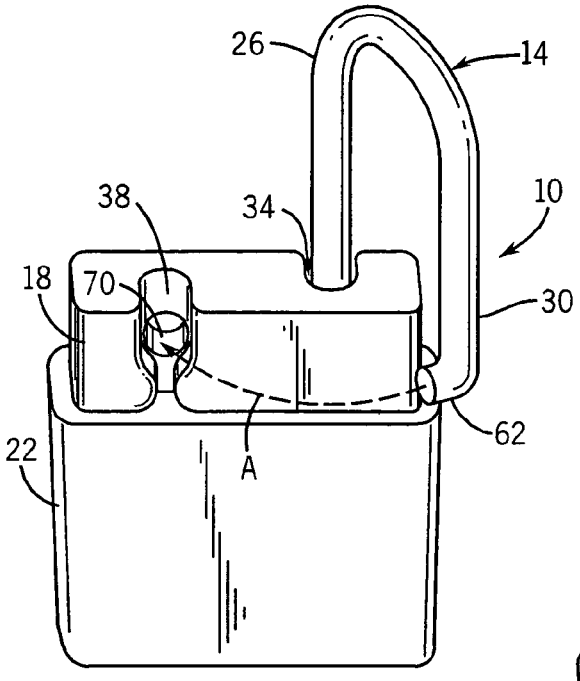
FIG. 1 is an isometric view of an embodiment of an unsecured lockout safety hasp of the present invention.

Referring to FIG. 1, a lockout hasp 10 is shown having a shackle 14, a body 18 and a cover 22. The lockout hasp 10 is in an unsecured position. The shackle 14 is partially retained within the body 18, and the body 18 is partially retained in the cover 22. The shackle 14 is U-shaped and has a cylindrical first beam 26 and a cylindrical second beam 30. The body 18 has first and second openings 34 and 38. The first beam 26 of the shackle 14 is partially secured within the first opening 34 of the body 18. The first beam 26 may rotate within the first opening 34 such that the shackle 14 rotates about the body 18. The shackle 14 may be rotated in the direction of arrow A such that the second beam 30 is received in the second opening 38. The cover 22 slidably receives the body 18 such that the cover 22 may be slid in the direction of arrow B to partially enclose the first and second openings 34 and 38.

Figure 2:
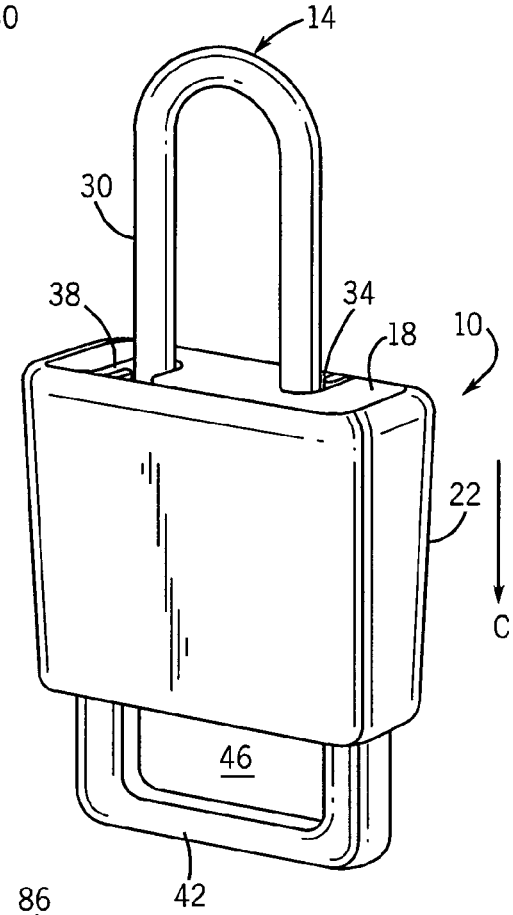
FIG. 2 is an isometric view of the secured lockout safety hasp of FIG. 1.

Referring to FIG. 2, the lockout hasp 10 is in a secured position with the second beam 30 retained in the second opening 38 and the cover 22 positioned about the body 18 such that the second beam 30 cannot be rotated out of the second opening 38. The body 18 includes a securing beam 42 that defines a padlock opening 46 along the body 18 opposite the first and second openings 34 and 38. The padlock opening 46 is exposed when the cover 22 is slid up and the lockout hasp 10 is in the secured position as shown in FIG. 2, and the padlock opening 46 is received in the cover 22 when the cover 22 is slid down in the direction of arrow C and the lockout safety hasp 10 is in the unsecured position as shown in FIG. 1.

Figure 8:
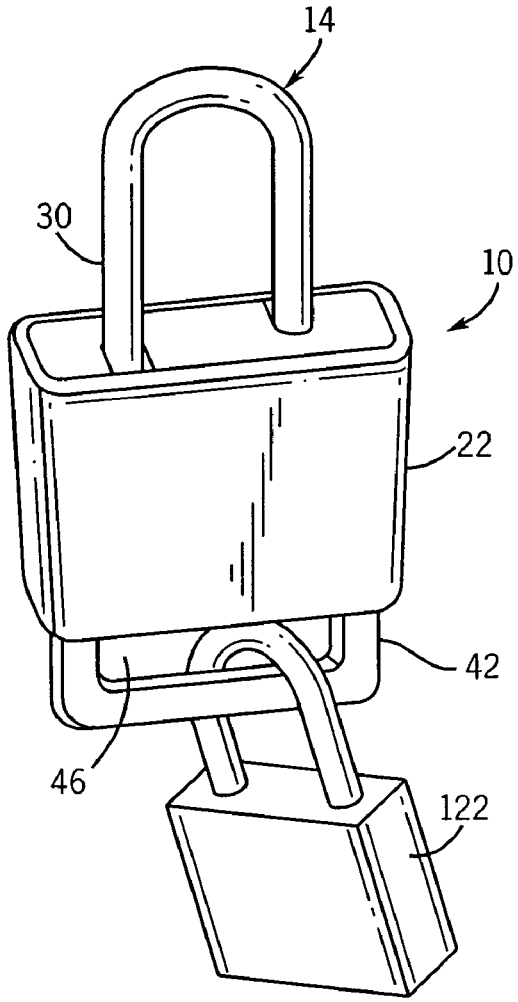
FIG. 8 is an isometric view of the lockout hasp of the present invention and a padlock.

In operation, a technician takes the unsecured lockout hasp 10 of FIG. 1 and rotates the shackle 14 about a corresponding lockout hasp on a piece of machinery. The lockout hasp on the machinery is positioned on a safety device to prevent access to operational controls of the machinery. The technician then rotates the body 18 until the second beam 30 of the shackle 14 is received in the second opening 38 of the body 18. The technician then slides the cover 22 up in the direction of arrow B such that the lockout hasp 10 is in the secured position shown in FIG. 2. The technician then secures a padlock 122 or any other locking device within the padlock opening 46 about the securing beam 42 as shown in FIG. 8 in order that the cover 22 can not slide down in the direction of arrow C and leave the lockout hasp 10 in the unsecured position. Thus, the technician is able to prevent others from accessing the operational controls of the machinery.

Figure 3:
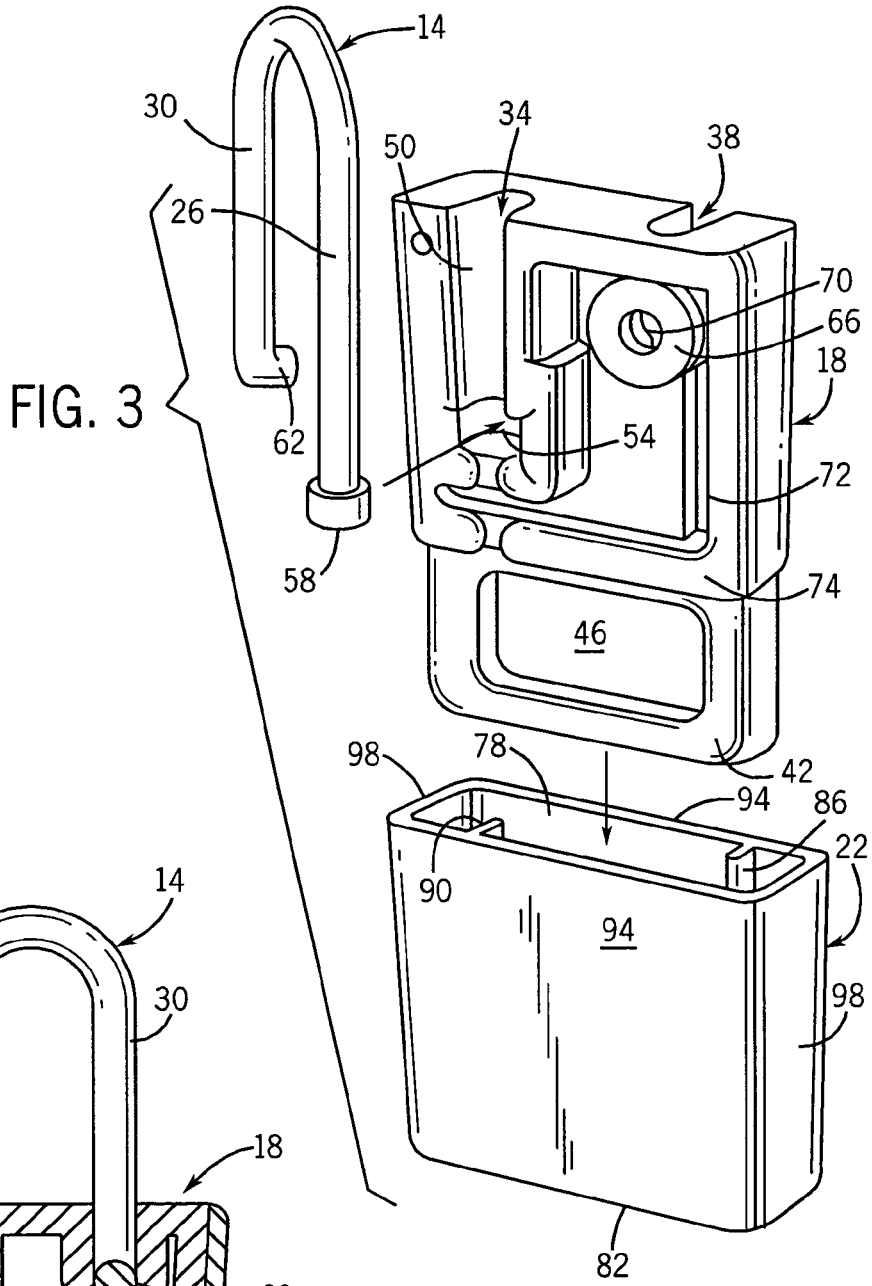
FIG. 3 is an exploded isometric view of the lockout hasp of the present invention.

Referring to FIG. 3, the first beam 26 of the shackle 14 includes a cylindrical disk 58 at an end thereof. The second beam 30 includes a cylindrical protrusion 62 at an end thereof. The protrusion 62 extends perpendicularly from the second beam 30. During production, the shackle 14 is made of a rugged plastic polymer and is formed by an injection molding process. Alternatively, the shackle 14 may be made of any number of other rigid synthetic materials. Alternatively, the shackle 14 may be made of metal. By way of example only, the shackle 14 may be made of steel or aluminum. If the shackle 14 is made of metal, the shackle 14 may not include the protrusion 62. Although a cylindrical disk 58 is shown, it will be apparent that various other connecting projections could be used. For example, a spherical ball could also be used.

The first opening 34 of the body 18 extends along a channel 50 to a chamber 54. The chamber 54 is wider than the channel 50. The second opening 38 of the body 18 extends along a thin gap 72 to a base 74 of the body 18. The second opening 38 is proximate a retention cylinder 66. The retention cylinder 66 has a hole 70 that faces perpendicularly to the gap 72. The securing beam 42 extends from the body 18 at the base 74. During production, the body 18 is made of a rugged plastic polymer and is formed by an injection molding process.

The cover 22 is generally rectangular in shape and is defined by side walls 94 formed with end walls 98. The cover 22 has an open top end 78 and an open bottom end 82.

Figure 4:
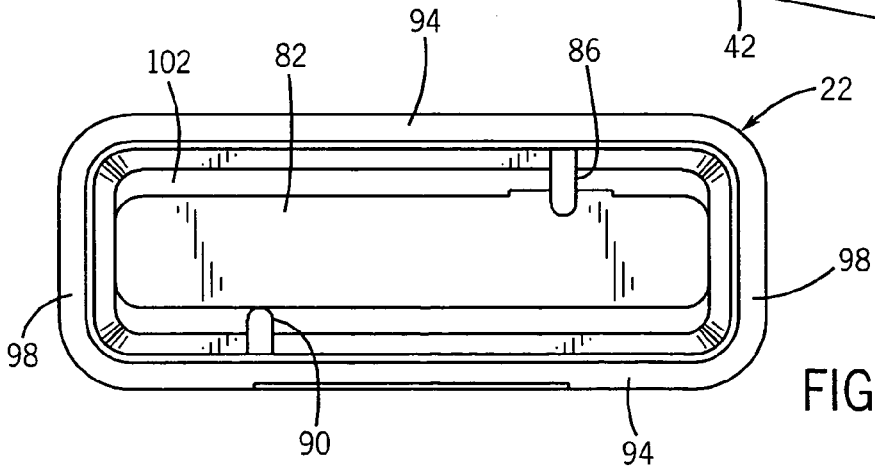
FIG. 4 is a top view of a cover of the present invention.

Referring to FIG. 4, the cover 22 has first and second retention beams 86 and 90 that extend inward from the side walls 94. The second retention beam 86 has an inwardly extending ledge 106 (FIG. 7) located midway along the length thereof. The cover 22 has a shelf 102 extending inward from the side and end walls 94 and 98 along the interior thereof proximate the open bottom end 82. During production, the cover 22 is made of a rugged plastic polymer and is formed by an injection molding process.

Figure 5:
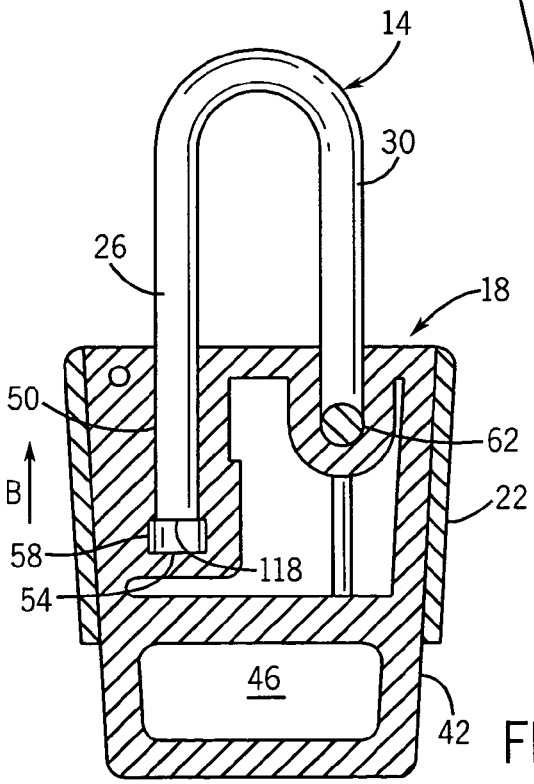
FIG. 5 is a side view of the shackle of FIG. 3 and the body of FIG. 4.

Referring to FIG. 5, the disk 58 on the first beam 26 of the shackle 14 is received within the chamber 54 of the body 18. The disk 58 may rotate within the chamber 54, but walls 118 extending along the channel 50 engage the disk 58 such that the disk may not be pulled out of the body in the direction of arrow B. As the disk 58 rotates within the chamber 54, the entire shackle 14 rotates about the body 18. The shackle 14 is rotated such that the second beam 30 is received in the second opening 38 (FIG. 3) with the protrusion 62 received in the hole 70 (FIG. 3).

Returning to FIG. 1, the second opening 38 is shown extending to the hole 70. The shackle 14 may be rotated in the direction of arrow A such that the protrusion 62 is secured within the hole 70. By retaining the protrusion 62 in the hole 70, the shackle 14 is better secured within the body 18 and the lockout hasp 10 is thus a stronger lock.

Figure 6:
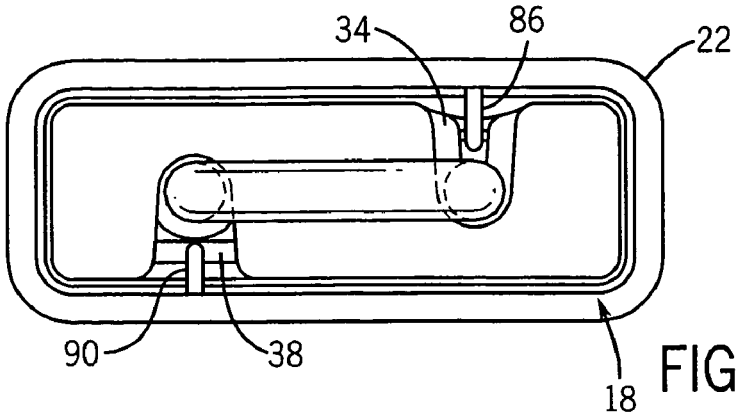
FIG. 6 is a top view of the body of FIG. 4 and the cover of FIG. 5.

Referring to FIG. 6, the body 18 is shown in the secured position within the cover 22 with the shackle 14 removed. The first retention beam 86 is received along the channel 50 of the first opening 34 in the body 18. The second retention beam 90 is received along the gap 72 (FIG. 3) of the second opening 38 in the body 18.

Figure 7:
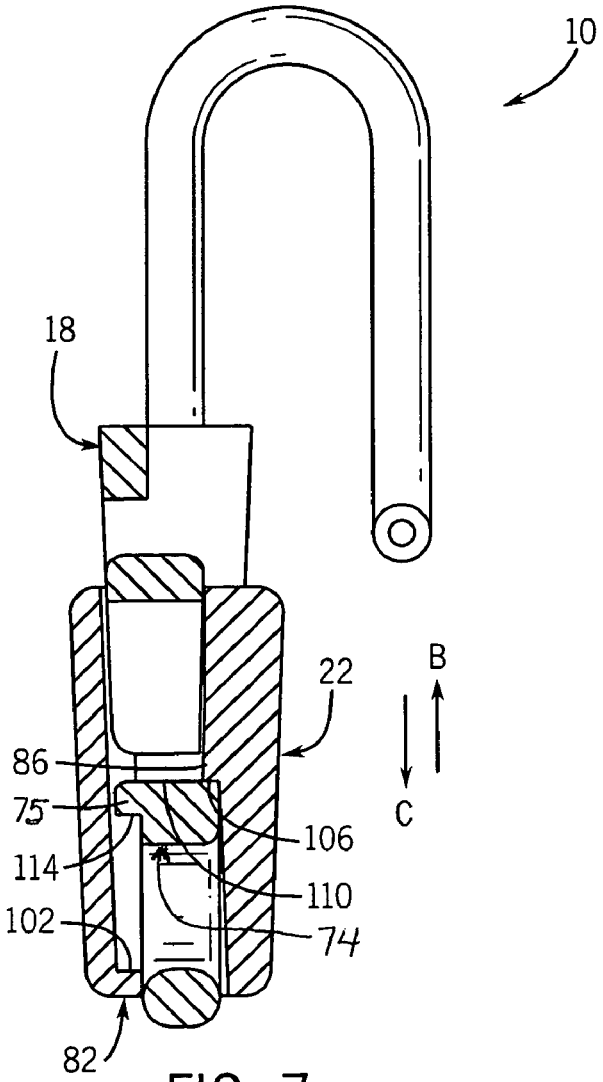
FIG. 7 is a cross-sectional view of the lockout safety hasp of the present invention.

Referring to FIG. 7, the body 18 is shown being slidably retained within the cover 22. The ledge 106 extending from the second retention beam 86 engages a top surface 110 of the base 74 of the body 18 such that the body 18 cannot be slid out of the cover 22 in the direction of arrow B. When the ledge 106 engages the base 74 as shown here in FIG. 7, the lockout safety hasp 10 is in the unsecured position of FIG. 1. The shelf 102 extending inwardly along the bottom end 82 of the cover 22 engages a bottom surface 114 of an outwardly extending stop projection 75 of the base 74 of the body 18 such that the body 18 cannot be slid out of the cover 22 in the direction of arrow C. When the shelf 102 engages the base 74, the lockout safety hasp 10 is in the secured position of FIG. 2. Thus, the shelf 102 and the ledge 106 operate to maintain the body 18 within the cover 22, providing stop projections for limiting motion of the cover 22 on the body 18.

Returning to FIG. 8, the shackle 14 of the secured lockout hasp 10 is secured about the lockout hasp of the machinery and then each technician working on the machinery may secure the lockout hasp 10 by placing a padlock 122 within the padlock opening 46. The hasps of the individual padlocks prevent the cover 22 from sliding down in the direction of arrow C along the body 18 and exposing the second beam 30 of the shackle 14. Each technician can retain the shackle 14 of the lockout hasp 10 about the machinery by the interference created between the technician's inserted padlock shackle and the cover 22. Thus, each technician may secure the machinery in a safe operational mode while he or she works on the machinery. The padlock opening 46 is large enough to accommodate several padlocks 122. In alternative embodiments, the padlock opening 46 may have different sizes and shapes to accommodate different numbers and types of locking devices used by technicians.

During production, the shackle 14, body 18 and cover 22 are all separately formed by injection molding. The shackle 14 is snapably positioned within the body 18 as shown in FIG. 5 with the disk 58 being snapped into the chamber 54. The body 18 and the shackle 14 are then snapably inserted into the cover 22 such that base 74 of the body 18 is positioned between the ledge 106 and shelf 102 of the cover 22, as shown in FIG. 7. Because the lockout hasp 10 is easily assembled by injection molding three individual parts and then snapping together the three parts, the lockout hasp 10 is much less expensive and time-consuming to assemble than a conventional metal safety hasp. Additionally, the plastic used to make the parts may easily be colored during production such that the assembled lockout hasp 10 has a color designation for a particular kind of technician. Further, the shackle 14 is thick and is made of a rugged polymer such that it is much stronger and can withstand more wear than a nylon hasp. Additionally, as mentioned above, the shackle 14 may be made of metal and used with a plastic body 18 and plastic cover 22 if greater strength is necessary. Therefore, the lockout hasp 10 is stronger and more secure than a conventional nylon lockout safety hasp.

Although a specific construction of the lockout hasp has been described above, it will be apparent that various modifications could be made within the scope of the invention. For example, although a rotatable shackle has been shown and described, a stationary hasp including an open end which is closed by motion of the cover could also be used. Furthermore, while the hasp is described as having the securing beam molded as part of the body, these components could be constructed separately. Furthermore, while specific types of projections, such as the cylindrical disk 58 and cylindrical projection 62 are shown at the ends of the shackle, it will be apparent that various other types of connecting devices can be used to provide the same function.

While the invention has therefore been described with reference to certain embodiments, it will be understood by those skilled in the art that various modifications in form and detail may be made therein without departing from the scope and spirit of the invention. Accordingly, modifications such as those suggested above, but not limited thereto, are to be considered within the scope of the invention.

I claim:

1. A lockout hasp comprising:

a body;

a shackle coupled to and extending from a first end of the body;

a securing beam extending from the second end of the body, the securing beam including first and second ends which are coupled to the body to provide a padlock opening for receiving a shackle from a plurality of padlocks; and a cover slidably received on the body, wherein the cover is slidable between a first position in which the shackle is closed and a second position in which the shackle is open, the cover being prevented from moving by interference between a first padlock received on the U-shaped securing beam and the cover, and wherein the body includes a channel extending from the first end of the body for receiving the shackle, and the cover includes at least one internally-extending retention beam, the retention beam being sized and dimensioned to be received in the channel formed in the body.

2. The lockout hasp as defined in claim 1, wherein the body includes a first and a second opening for receiving the shackle.

3. The lockout hasp as defined in claim 1, wherein the shackle includes a first end which is rotatably secured in one of the first and second openings and a second end which is moveable relative to the body.

4. The lockout hasp as defined in claim 1, wherein the securing beam is U-shaped.

5. The lockout hasp as defined in claim 1, wherein the securing beam is integral with the body.

6. The lockout hasp as defined in claim 1, wherein the shackle includes a cylindrical disk on the first end and a perpendicularly-extending cylindrical projection on the second end.

7. The lockout hasp as defined in claim 2, wherein at least one of the first and second openings in the body extend along a the channel extending from the first end of the body, and wherein the channel extends along a side of the body.

8. The lockout hasp as defined in claim 1, wherein the retention beam includes a stop projection extending inwardly toward the center of the cover, the stop projection interacting with an outwardly extending projection in the body to limit motion of the cover.

9. The lockout hasp as defined in claim 1, wherein the cover, the body, the securing beam and the shackle are each constructed of a plastic material.

10. The lockout hasp as defined in claim 1, wherein the cover, the body, the securing beam and the shackle are each constructed of a plastic polymer material.

11. The lockout hasp as defined in claim 1, wherein the cover, the body, and the securing beam are each constructed of a colorable plastic material.

12. The lockout hasp as defined in claim 1, wherein the cover, the body, the securing beam and the shackle are each injection molded in a plastic material.

13. A lockout hasp comprising:

a body having first and second channels extending from a top edge of the body and along a side edge of the body;

a U-shaped securing beam extending from a second end of the body, the U-shaped securing beam providing a padlock opening sized and dimensioned to receive a plurality of padlocks;

a shackle including a first end which is rotatably secured in one of the first and second channels and a second end which is moveable around the rotatably secured end and relative to the body; and a cover slidably engaged in the body and moveable between an open position in which the shackle is free to rotate and a closed position in which the shackle is locked, the cover being prevented from moving to the open position when a padlock is locked on the U-shaped securing beam and wherein the cover includes at least one retention beam sized and dimensioned to be received in a corresponding one of the first and second channels to facilitate sliding movement of the cover.

14. The lockout hasp as defined in claim 13, wherein the cover includes first and second retention beams sized and dimensioned to be received in the first and second channels to facilitate sliding movement of the cover.

15. The lockout hasp as defined in claim 13, wherein the padlock opening is sized and dimensioned to substantially limit motion of a shackle of a padlock positioned in the padlock opening.

16. The lockout hasp as defined in claim 13, wherein the second end of the shackle includes a cylindrical projection which is sized and dimensioned to be received in a hole provided in the body.

17. The lockout hasp as defined in claim 13, wherein the first and second channels are provided on opposing sides of the body.

18. The lockout hasp as defined in claim 13, wherein the U-shaped securing beam is formed integral with the body.

19. A lockout hasp comprising:

a substantially U-shaped shackle including a connecting projection extending from at least one distal end of the shackle;

a body including a first and a second channel, each of the channels sized and dimensioned to receive a leg of the shackle and each of the channels extending from a top end of the body and along a side edge of the body, a chamber being formed at the bottom of the first channel and sized and dimensioned to receive the connecting projection formed in the shackle, and a U-shaped securing beam extending beneath a bottom edge of the body sized and dimensioned to receive a plurality of padlock shackles for a lockout; and a cover including first and second retention beams sized and dimensioned to be received in the first and second channels, wherein the shackle is positioned in the two channels and the connecting projection is snap-fit into the chamber in the body and the first and second retention beams are snap fit into the channels of the cover, wherein the cover is slidable along the body between a first position in which the cover encloses the channel to prevent rotation of the shackle and a second position in which the cover is moved from the channel sufficiently to allow rotation of the shackle.

20. The lockout hasp as defined in claim 19, wherein the body further comprises a base portion including an outwardly extending stop projection provided above a bottom end of the body.

21. The lockout hasp as defined in claim 20, wherein the cover includes a first and a second inwardly extending stop projection, and wherein the base portion is positioned between the first and second inwardly extending stop projections in the cover when the cover is provided on the body, the first and second inwardly extending stop projection in the cover interacting with the outwardly extending stop projection in the base to limit motion of the cover.

22. The lockout hasp as defined in claim 19, wherein the cover includes first and second retention beams extending inwardly along the sides of the cover, the retention beams being received in the first and second channels in the body.

23. The lockout hasp as defined in claim 19, wherein the shackle, the cover, and the body are each injection molded from a polymer plastic.

24. The lockout hasp as defined in claim 19, wherein the shackle is rotatable about the connecting projection.

25. The lockout hasp as defined in claim 19, wherein the first and second channels are formed on opposing sides of the body.

26. The lockout hasp as defined in claim 19, wherein the shackle is constructed of steel.

27. The lockout hasp as defined in claim 19, wherein the connecting projection is a cylindrical disk.

* * * * *